US007285016B1

(12) United States Patent
Lai et al.

(10) Patent No.: US 7,285,016 B1
(45) Date of Patent: Oct. 23, 2007

(54) CONNECTOR

(75) Inventors: Ming-Chun Lai, Tu-Cheng (TW); Mao-Jung Huang, Tu-Cheng (TW); Yu Li, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/603,828

(22) Filed: Nov. 24, 2006

(51) Int. Cl.
*H01R 13/648* (2006.01)

(52) U.S. Cl. ..... 439/607

(58) Field of Classification Search ..... 439/607, 439/608–611, 70–73, 85–86, 504, 331
See application file for complete search history.

(56) References Cited

U.S. PATENT DOCUMENTS 6,123,552 A * 9/2000 Sakata et al. ..... 439/71
6,585,540 B2 * 7/2003 Gutierrez et al. ..... 439/620.19
6,962,511 B2 * 11/2005 Gutierrez et al. ..... 439/676
2003/0199197 A1 * 10/2003 Yu et al. ..... 439/607
2004/0123458 A1 * 7/2004 Korsunsky et al. ..... 29/874

* cited by examiner

*Primary Examiner*—J. F. Duverne
(74) *Attorney, Agent, or Firm*—Rosenberg, Klein & Lee

(57) ABSTRACT

A connector assembly includes a dielectric housing and a plurality of conductive terminals. The dielectric housing defines a plurality of terminal slots and terminal pores, which together contain said conductive terminals. Said terminal pores are defined on both sides of the dielectric housing. Each of the conductive terminals contains a vertical leg, and the vertical leg bends sideward and forms a bending portion, the bending portion extends upward bends to form a grasping portion. The grasping portion expands an arm and forms a contact portion at its end. The bending portions bending left and those bending right together forms a space between their vertical legs, which divides the vertical legs into two groups. The vertical legs are contained into said terminal pores and extrude beyond the bottom surface of the dielectric housing. Thus, an interspace for extra cables threading through is formed between the two groups of vertical legs.

5 Claims, 5 Drawing Sheets

CONNECTOR

BACKGROUND OF THE INVENTION

1. Field of the Invention

This invention generally relates to a connector assembly and more particularly to an electrical connector mounted on a printed circuit board.

2. The Related Art

The game industry is prospering with the development of computer technology in recent years, which expands the market of video game console manufacture greatly. The video game console demands good human-computer interactions. Recently, a new-fashioned product is developed to provide with more realistic and direct feelings. This kind of video game console transfers 300 million polygons (in which forms the game images are shown) per second, comparing with a rate of 66 million per second of traditional kinds.

The high-speed human-computer interaction is a good challenge to present data-transfer technology. One of the general countermeasure is to enhance the length of data the processor handles. The other is to enlarge the width of or append additional cables that transfer the data of the game to the processor, especially of those connectors that proved to be a bottle-neck.

However, in the conventional connectors, the feet portions of the conductive terminals are arranged in a matrix form. When the connectors are mounted to the printed circuit board, their feet portions match the board tightly and leave no space for those added cables to thread through between the connector and printed circuit board when needed.

SUMMARY OF THE INVENTION

In view of the foregoing, the present invention is proposed to provide a connector to conquer the disadvantage mentioned above. The present invention of connector comprises a dielectric housing and a plurality of conductive terminals. The dielectric housing has a plurality of terminal slots parallel to a top surface of the dielectric housing and a plurality of terminal pores corresponding to said terminal slots defined in the dielectric housing. Each of the conductive terminals has a vertical leg and a grasping portion bending from the vertical leg, the grasping portion forming a contact portion at a front end of the grasping portion. The terminal slots and the terminal pores are perpendicular to one another. The terminal pores are defined on both sides of a bottom surface of the dielectric housing. The grasping portions are inserted into the terminal slots. The vertical legs are inserted into the terminal pores and extended though a bottom surface of the dielectric housing. So a region is defined between two sides of the bottom surface of the dielectric housing.

As described above, between the vertical legs of the conductive terminals, an interspace is left for cables threading through when needed. In that case, the connector conquers the disadvantage of the present connectors.

BRIEF DESCRIPTION OF THE DRAWINGS

A detailed explanation of a preferred embodiment of the present invention will be given, with reference to the attached drawings, for better understanding thereof to those skilled in the art.

DETAILED DESCRIPTION OF THE PREFERRED EMBODIMENT

Figure 1:
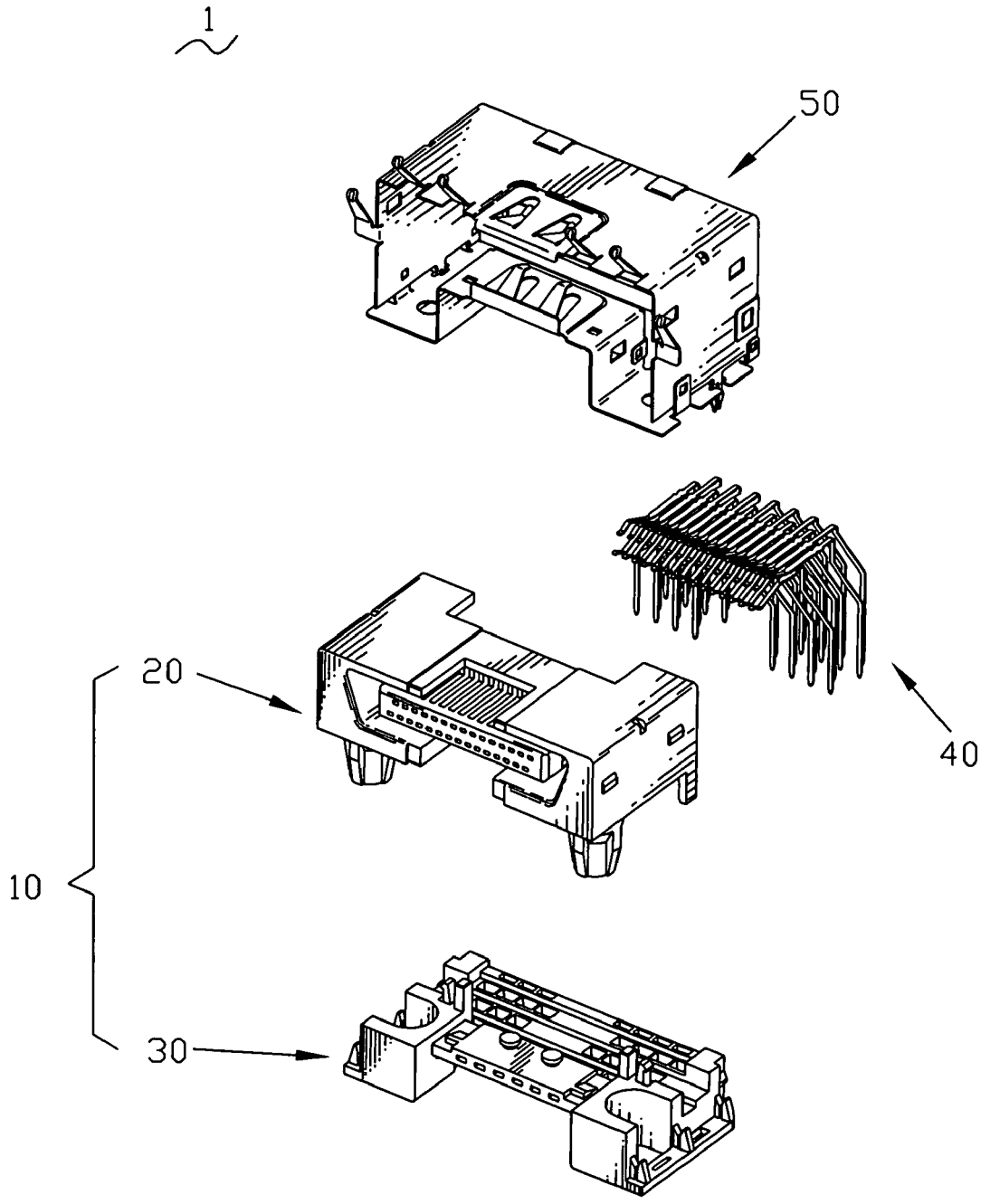
FIG. 1 is an exploded view of a connector assembly in accordance with the present invention.
Figure 2:
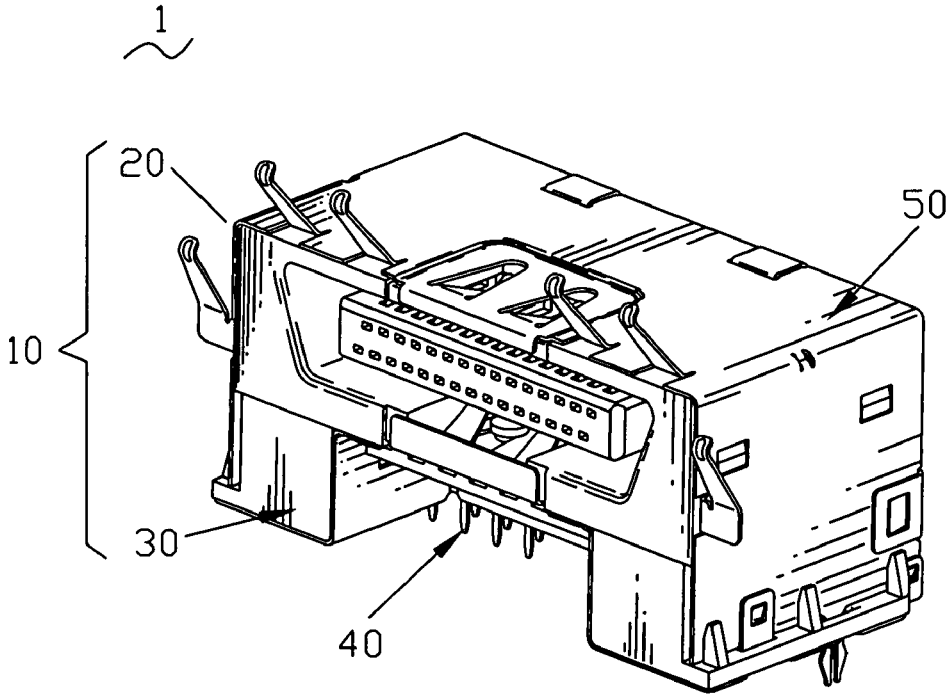
FIG. 2 is a perspective view of a connector assembly in accordance with the present invention.

Referring to FIGS. 1 and 2, a connector assembly 1 according to the present invention includes a dielectric housing 10 having an upper body 20 and a lower body 30, a plurality of conductive terminals 40 is retained in the dielectric housing 10, and a metal shelter 50 is engaged with the dielectric housing 10.

Figure 3:
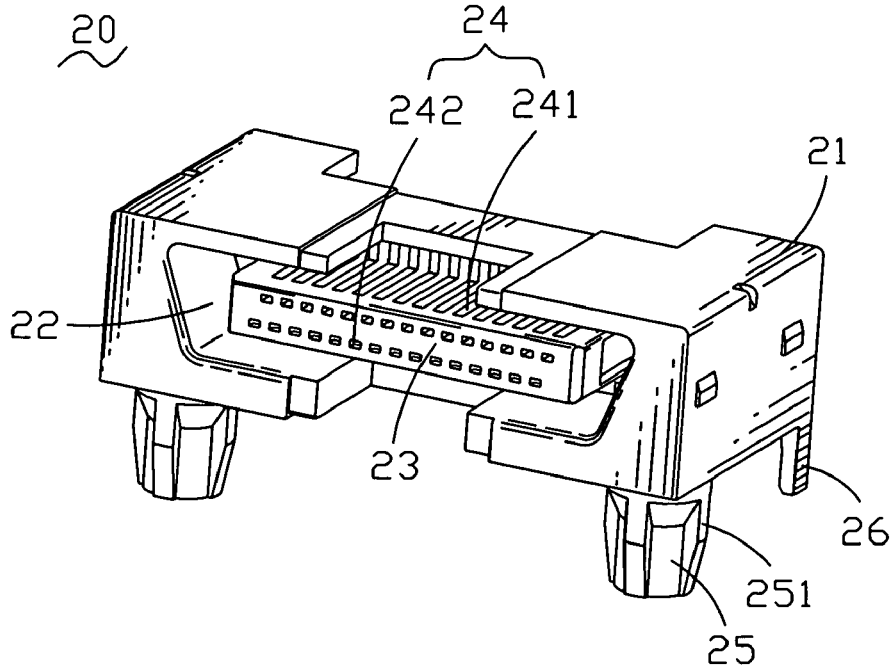
FIG. 3 is a perspective view of the upper body shown in FIG. 1.

With reference to FIG. 3, an upper body 20 contains a tetrahedron base 21. A container space 22 is defined inside of the base 21, whose section is in an isosceles trapezoid shape. A tenon 23 is set in the container space 22 and extends to even out the front surface of the base 21. Two rows of terminal slots 24 are defined on the top and bottom surfaces in the body of the tenon 23. The terminal slots 24 on the top surface are superstratum slots 241 and on the bottom surface are underlayer slots 242. Each of the terminal slots 24 lies lengthways. At the front of the base 21 it extends out two inserting legs 25 downwards, each of which has dentations 251 on the body. And at its backside, two clamp legs 26 project downwards at both ends.

Figure 4:
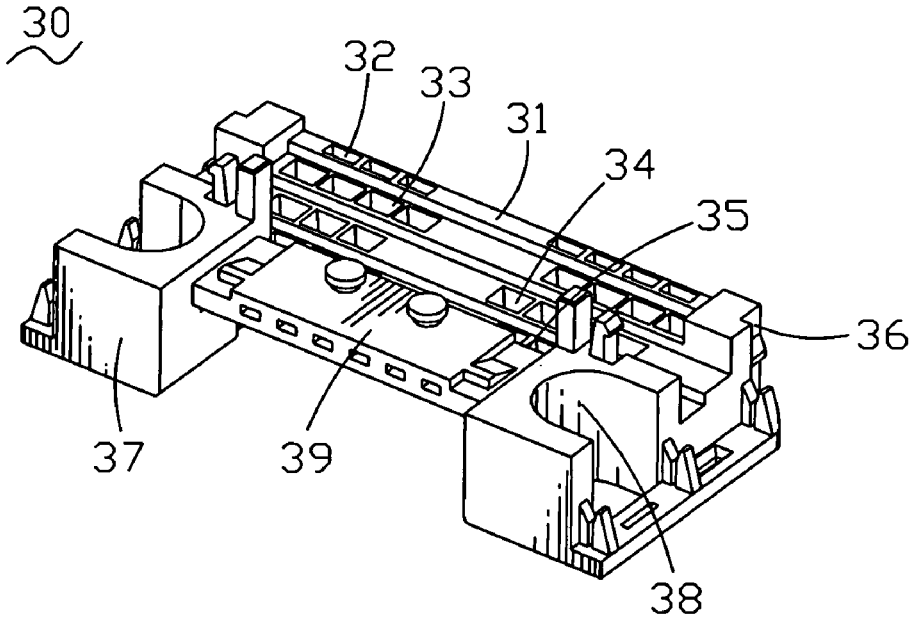
FIG. 4 is a perspective view of the lower body shown in FIG. 1.

Referring to FIG. 4, a lower body 30 includes a rear wall 31. The rear wall 31 is divided into four steps and with their heights descending equally from back to front. On the top surface of each step, a plurality of terminal pores is defined drilling through the step to the bottom surface to receive the conductive terminals 40 therein. These terminal pores, naming first terminal pores 32, second terminal pores 33, third terminal pores 34, fourth terminal pores 35, are assembled at the both ends of each step, leaving the middle part aside with no terminal pores defined. At the backside of the rear wall 31, two flutes 36 are defined sunkening into each end to match the two clamp legs 26 of the upper body 20. The front part of the lower body 30 consists of two fixing bases 37 arranged at each end. A semicircular fixing hole 38 drills through to receive the inserting legs 25 of the upper body 20 in assembly.

Figure 5:
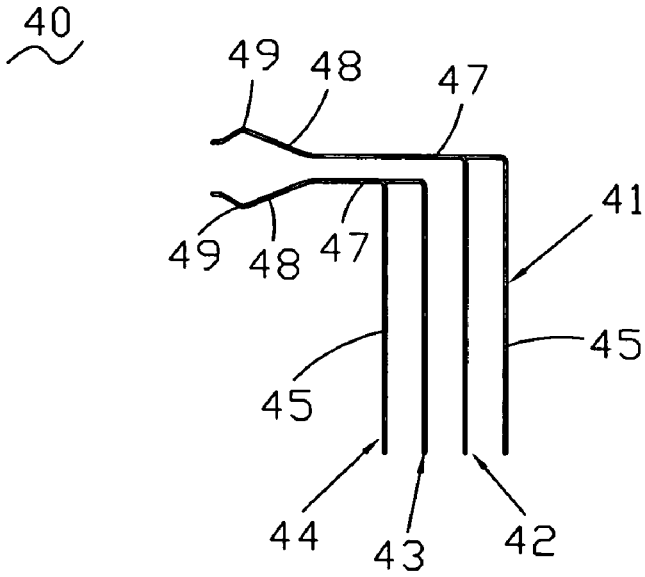
FIG. 5 is a perspective view of the conductive terminals.
Figure 6:
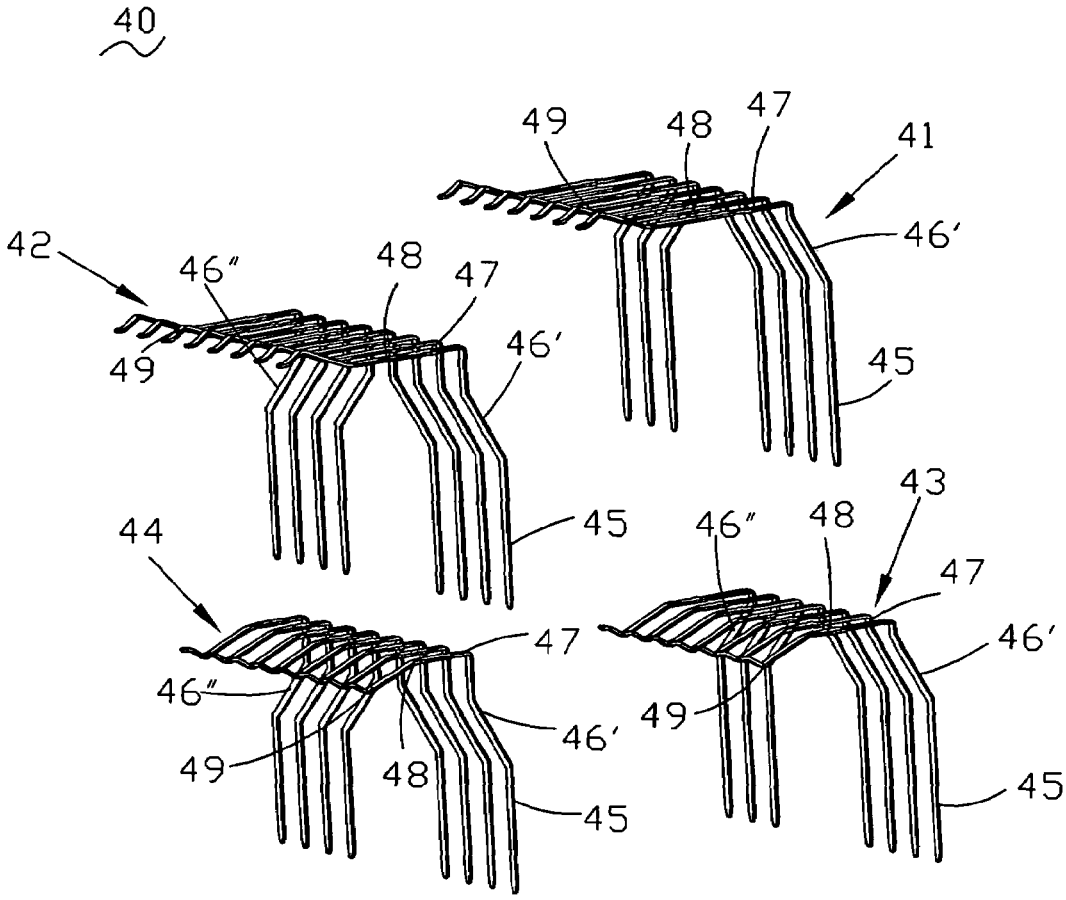
FIG. 6 is a composite view of the conductive terminals in assembly.

Referring to FIGS. 5 and 6, the conductive terminals 40 consist of four rows of terminals. The conductive terminals from back to front are: first conductive terminals 41, second conductive terminals 42, third conductive terminals 43 and fourth conductive terminals 44.

As shown in FIG. 5, each conductive terminal 40 contains a vertical leg 45. The top part of each vertical leg 45 bends sidewards and forms a bending portion. The end of the bending portion makes a 90° turn and then extends flatly and forms a grasping portion 47. The end of the grasping portion 47 makes a V shape turn and forms an arm 48. A contact portion 49 is formed at the peak. In assembly, the grasping portion 47 and arms 48 of the four rows of conductive terminals 40 are received in the terminal slots 24. Meanwhile, the vertical legs 45 are set into two groups that bend sideward and received in the terminal pores (shown in FIGS. 7 and 8), leaving an interspace 451 between the two groups vertical legs 45.

As FIG. 6 shows, the grasping portions 47 of the first conductive terminals 41, second conductive terminals 42, third conductive terminals 43 and fourth conductive terminals 44 are descending evenly in length. The grasping portions 45 of the first conductive terminals 41 and the second conductive terminals 42 are at the same height. The grasping portions 45 of the third conductive terminals 43 and fourth conductive terminals 44 are at a lower height. The arms 48 of the first and the second conductive terminals 41,42 are just above those of the third and four conductive terminals 43, 44. The arms 48 of the first and the second conductive terminals 41,42 bend in a reverse V shape, at the same time the arms of the third conductive terminals 43 and the fourth conductive terminals 44 bend in a V shape. Their peaks form said contact portions 49.

Referring to FIG. 6 again, the conductive terminals 40 can be divided into two groups by their bending portions. The bending portions 46' of left group terminals whose marked 46' bended leftwards. The bending portions 46" of right group terminals bend rightwards.

Figure 7:
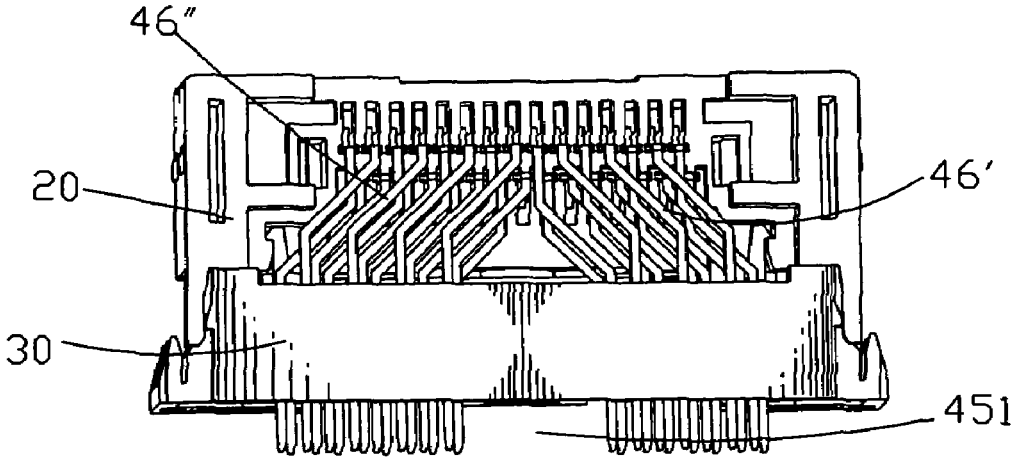
FIG. 7 is a rear view of the conductive terminals assembly in the dielectric housing.
Figure 8:
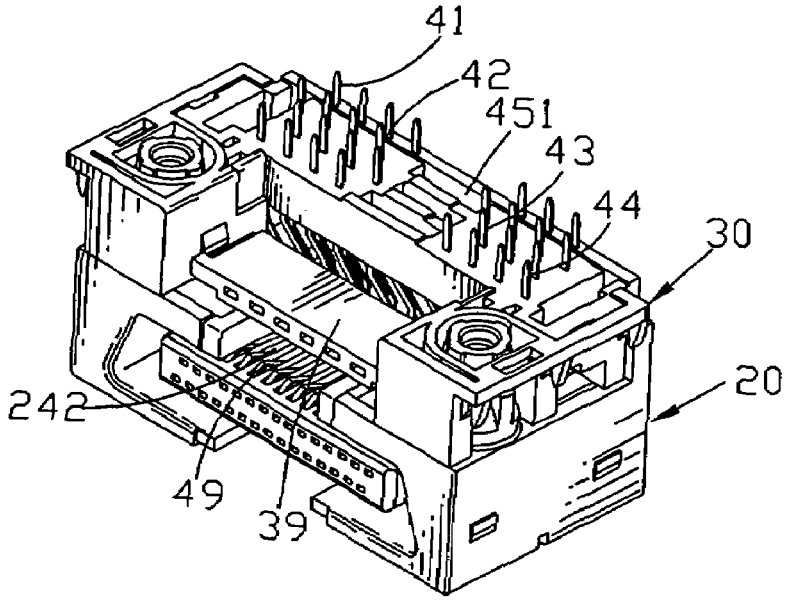
FIG. 8 is a bottom view of the connector assembly in accordance with the present invention.

Referring to FIGS. 7 and 8, in assembly, each of the conductive terminals 40 is retained in the dielectric housing 10. Each of the terminal slots 24 contains each of the grasping portions 47 and each of the arms 48 of a conductive terminal 40. The contact portions 49 of the conductive terminals 40 protrude upwards from the superstratum slots 241 to contact with the interface components (not shown) of other devices; each of the terminal slots receives in a vertical leg 45 respectively. As the grasping portions 47 of the first conductive terminals 41 are longer than those of the second conductive terminals 42, their vertical legs 45 locate at the back of the second conductive terminals 42. The grasping portions 47 of the third conductive terminals 43 and the fourth conductive terminals 44 are received in the underlayer slots 242 of the tenon 24 in the same form. As the grasping portions 47 of the third conductive terminals 43 longer than those of the fourth conductive terminals 44, their vertical legs 45 are set in two lines. Since the grasping portions 47 of the second conductive terminals 42 are longer than those of the third conductive terminals 43, the vertical legs 45 of the conductive terminals 40 are divided into four rows.

FIGS. 6, 7 and 8 show how the conductive terminals 40 are arranged in the dielectric housing 10. In said form, the conductive terminals 40 are divided into four rows according to the lengths of their vertical legs 45 and grasping portions 48. Their bending portions 46' bend leftwards and 46" rightwards separately forming a reversing U shaped wide space in order to be contained into those terminal pores; that is, the vertical legs 45 of the first conductive terminals 41 are received in the first terminal pores 32. The vertical legs 45 of the second conductive terminals 42, the third conductive terminals 43 and the fourth conductive terminals 44 are received in the second terminal pores 33, the third terminal pores 34 and the fourth terminal pores 35 respectively.

As described above, when the connector is mounted on a PC board, an interspace 451 between the connector and PC board is formed by those vertical legs 45 of the conductive terminals 40. Hence, the added cables (not shown) then could thread through the interspace 451, and more spare space is saved for further design.

Although preferred embodiment of the present invention have been described in detail hereinabove, it should be clearly understand that many variations and/or modifications of the basic inventive concepts herein taught which may appear to those skilled in the present art will fall within the spirit and scope of the present invention, as defined in the appended claims.

What is claimed is:

1. A connector comprising:

a plurality of conductive terminals, each having a vertical leg, a grasping portion formed and bending at the top end of the vertical leg, the grasping portion expanding horizontally and forming an arm and a contact portion at the front end;

a dielectric housing, having a base at the top with a tenon inside, the tenon defining a plurality of terminal slots parallel to a top surface of the dielectric housing to contain the grasping portion, a plurality of terminal pores defined in the bottom surface of the dielectric housing to receive the vertical legs of the conductive terminals respectively;

wherein the terminal slots and terminal pores of the dielectric housing are perpendicular to one another, the terminal pores defined on both sides of a bottom surface of the dielectric housing;

the conductive terminals which are separated into a left group terminals and a right group terminals, the vertical leg of each left group terminals leaning upwards to the right side thereof to form a left bending portion, the vertical leg of each right group terminals leaning upwards to the left side thereof to form a right bending portion, a wide space being defined between the left group terminals and the right group terminals, the vertical legs of the conductive terminals inserted into the terminal pores respectively and extended though a bottom surface of the dielectric housing, so that an interspace is defined between two sides of the bottom surface of the dielectric housing;

wherein the conductive terminals are further separated into four rows, including: first conductive terminals, second conductive terminals, third conductive terminals and fourth conductive terminals, the bottom ends of their vertical legs positioned at the same level, their bending portions extending horizontally to form grasping portions, the grasping portions being shortened from the first conductive terminals to the fourth conductive terminals evenly, the bending portions of the first conductive terminals and second conductive terminals both positioned at the same level, the bending portions of the third conductive terminals and fourth conductive terminals positioned at a lower level, the arms and grasping portions of the first and second conductive terminals located above the grasping portions of the third and fourth conductive terminals.

2. The connector as claimed in claim 1, wherein the arm is formed at the end of each grasping portion, each arm of the first conductive terminals and the second conductive terminals bending in a reverse V shape, each of the arms of the third conductive terminals and the fourth conductive terminals bending in a V shape, the peaks of the arms form said contact portions.

3. A connector comprising:

a plurality of conductive terminals, each having a vertical leg, a grasping portion formed and bending at the top end of the vertical leg, the grasping portion expanding horizontally and forming an arm and a contact portion at the front end;

a dielectric housing, having a base at the top with a tenon inside, the tenon defining a plurality of terminal slots parallel to a top surface of the dielectric housing to contain the grasping portion, a plurality of terminal pores defined in the bottom surface of the dielectric housing to receive the vertical legs of the conductive terminals respectively;

wherein the terminal slots and terminal pores of the dielectric housing are perpendicular to one another, the terminal pores defined on both sides of a bottom surface of the dielectric housing;

the conductive terminals which are separated into a left group terminals and a right group terminals, the vertical leg of each left group terminals leaning upwards to the right side thereof to form a left bending portion, the vertical leg of each right group terminals leaning upwards to the left side thereof to form a right bending portion, a wide space being defined between the left group terminals and the right group terminals, the vertical legs of the conductive terminals inserted into the terminal pores respectively and extended though a bottom surface of the dielectric housing, so that an interspace is defined between two sides of the bottom surface of the dielectric housing;

wherein said dielectric housing comprises an upper body and a lower body, the upper body having two inserting legs extending downwards from its front end, two clamp legs projecting downwards at both ends of the back part, the lower body defining two fixing holes corresponding to the two clamp legs, a flute hollowed out into each end of the back part of the lower body, the inserting legs received into the fixing hole, the clamp legs matching said flutes, the plurality of terminal slots defined in the upper body, the plurality of terminal pores defined in the lower body.

4. The connector as claimed in claim 3, wherein the lower body includes a rear wall, the rear wall divided into four steps with a height from third terminal pores and fourth terminal pores are defined at both ends of each step from back to front successively, the conductive terminals divided into four rows as first conductive terminals, second conductive terminals, third conductive terminals, fourth conductive terminals in turn which are received in the first terminal pores, second terminal pores, third terminal pores and fourth terminal pores respectively.

5. The connector as claimed in claim 1, wherein the connector contains a metal shelter engaged with the dielectric housing.

* * * * *